US010035039B1

(12) United States Patent
Jui

(10) Patent No.: US 10,035,039 B1
(45) Date of Patent: Jul. 31, 2018

(54) CONVERTIBLE CONVERSION TABLE EXERCISER

(71) Applicant: Michael Jui, Elkton, FL (US)

(72) Inventor: Michael Jui, Elkton, FL (US)

( * ) Notice: Subject to any disclaimer, the term of this patent is extended or adjusted under 35 U.S.C. 154(b) by 9 days.

(21) Appl. No.: 15/342,390

(22) Filed: Nov. 3, 2016

(51) Int. Cl.

| | |
|---|---|
| ***A63B 26/00*** | (2006.01) |
| ***A63B 21/00*** | (2006.01) |
| ***A63B 23/02*** | (2006.01) |
| ***A63B 23/12*** | (2006.01) |
| ***A63B 23/04*** | (2006.01) |
| *A63B 23/00* | (2006.01) |

(52) U.S. Cl.
CPC ..... *A63B 21/4035* (2015.10); *A63B 21/4034* (2015.10); *A63B 21/4047* (2015.10); *A63B 23/0238* (2013.01); *A63B 23/0405* (2013.01); *A63B 23/1218* (2013.01); *A63B 23/1227* (2013.01); *A63B 2023/006* (2013.01); *A63B 2023/0411* (2013.01)

(58) Field of Classification Search
CPC ..... A63B 21/4035; A63B 23/1227; A63B 23/0405; A63B 23/0238; A63B 21/4047; A63B 21/4034; A63B 23/1218; A63B 2023/0411; A63B 2023/006
See application file for complete search history.

(56) References Cited

U.S. PATENT DOCUMENTS

| | | | | |
|---|---|---|---|---|
| 7,361,128 | B2 * | 4/2008 | Chen | A61H 1/0218 482/142 |
| 7,534,200 | B1 | 5/2009 | Martinez | |
| 7,857,741 | B1 * | 12/2010 | Hsiung | A61H 1/0218 482/143 |
| 9,687,406 | B1 * | 6/2017 | Steiner | A61H 1/0218 |
| 2007/0032358 | A1 * | 2/2007 | Chen | A61H 1/0218 482/144 |
| 2007/0161477 | A1 * | 7/2007 | Wang | A61H 1/0218 482/144 |
| 2007/0298948 | A1 * | 12/2007 | Chen | A61H 1/0218 482/144 |

* cited by examiner

*Primary Examiner* — Garrett Atkinson
(74) *Attorney, Agent, or Firm* — Harpman & Harpman

(57) ABSTRACT

A convertible exercising inversion table having a main support frame with an inversion table pivotally mounted there between. Multiple exercise station receiving supports provided on the support frame and inversion table for sequential selective insertion of independent repositional user engagement gripping bars for different user exercises.

6 Claims, 5 Drawing Sheets

CONVERTIBLE CONVERSION TABLE EXERCISER

BACKGROUND OF THE INVENTION

1. Technical Field

This invention relates to exercising apparatus, specifically exercise inversion tables that provide for gravity inversion of the user.

2. Description of Prior Art

Prior art devices of this type have been developed to enable the user to easily practice gravity inversion by supporting their body on a pivoted table while holding their legs securely by their feet. Such exercise devices allow the user to stretch their body when in the inverted position, relieving pressure on the spine.

Examples of such inversion table exercising apparatus can be seen in U.S. Pat. No. 7,361,128 on an exercising apparatus. U.S. Pat. No. 7,534,200 for an apparatus for back therapy and multiple exercise. U.S. Pat. No. 7,857,741 for a continuation advanced crunch and gravity inversion exercise machine. U.S. Publication 2007/0032358 for an exercise inversion table.

In U.S. Pat. No. 7,361,128 a pivoted seat assembly can be seen suspended on a stationary frame. The seat assembly has a movable seat and back, allowing for progressive relative movement there between. A leg holder provides for user engagement and inversion of body support by pivoting the seat assembly within the frame.

U.S. Pat. No. 7,534,200 discloses a back therapy and exercising device having multiple exercise stations on a support frame with a back rest pad, forearm pads and handgrips.

U.S. Pat. No. 7,857,741 claims a combination device with a pivoting inversion table and leg holder for performing abdominal crunch exercises to strengthen the user's stomach muscle.

U.S. Publication 2007/0032358 discloses an inversion table having an ergonomic foot and leg support with an ankle support bar to improve the inversion table action during use.

SUMMARY OF THE INVENTION

A convertible multi-functional exercising inversion table that combines multiple exercising stations in a single table configuration. An inversion table is pivotally supported by an A-frame configuration between pivot bearing supports with an indexing locking assembly securing the table in multiple fixed exercising enabling positions within the pivot. A pair of removable exercise handgrip bars are adapted for independence placement for each of multiple exercises which are achievable on a single inversion table support structure including pushups, squats, parallel bar dips, leg raises and chin ups by repositioning the handgrip bars to the multiple exercise stations.

DETAILED DESCRIPTION OF THE INVENTION

Figure 1:
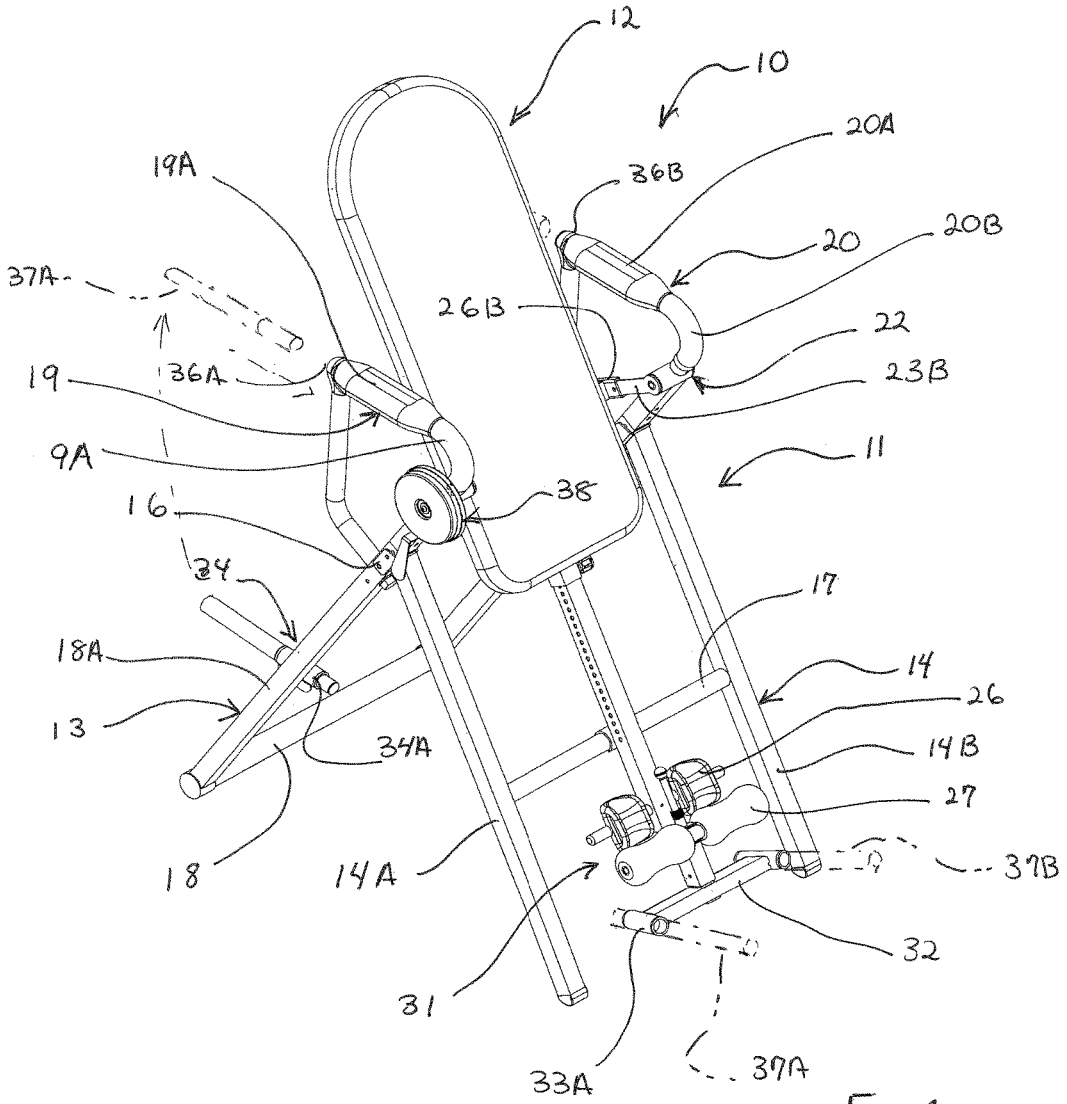
FIG. 1 is a front perspective view of the exercising inversion table of the invention.
Figure 2:
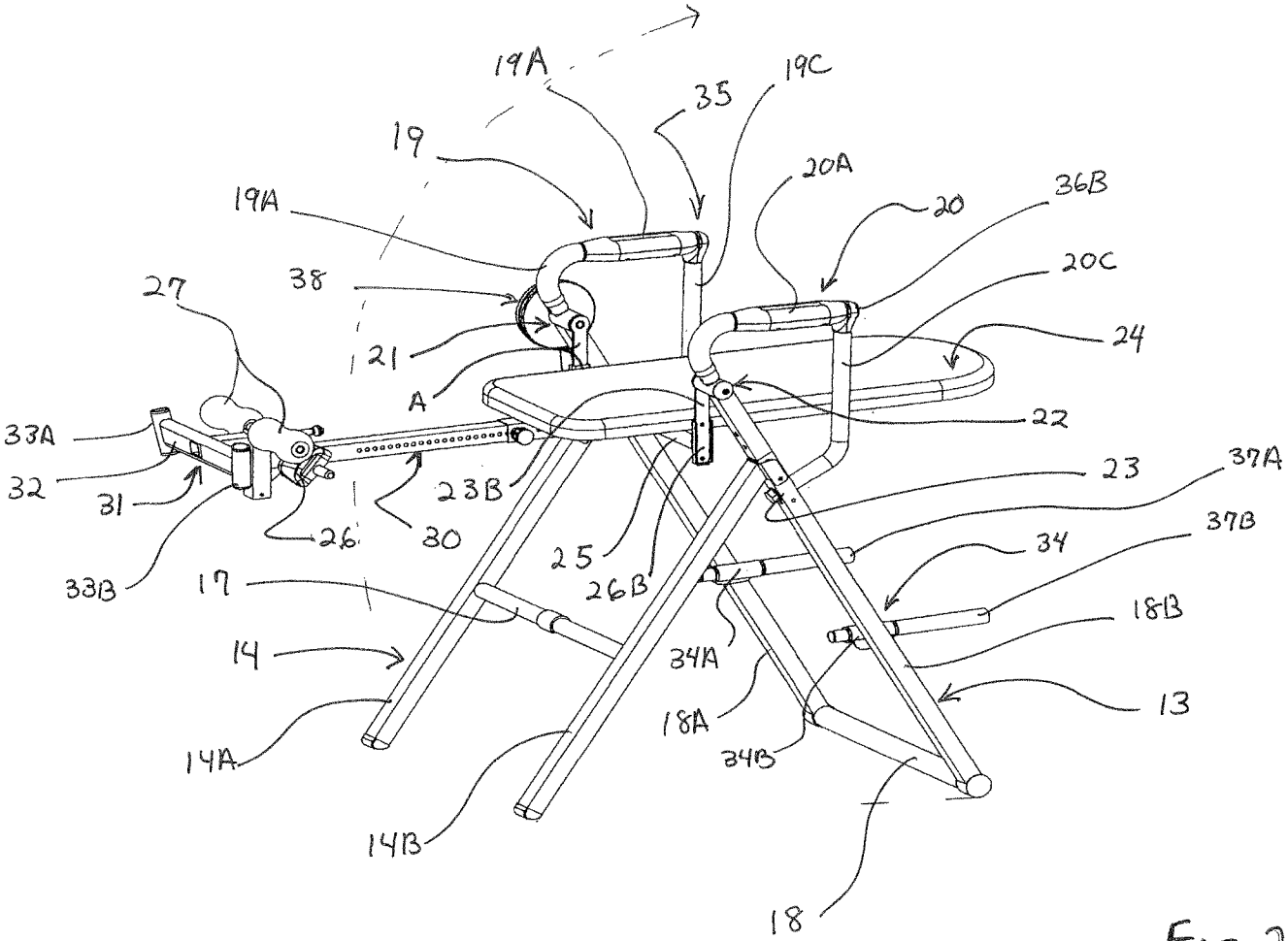
FIG. 2 is a side perspective view of the exercise inversion table and horizontal transitional to inverted position.

Referring now to FIGS. 1 and 2 of the drawings, an inversion table exercising device 10 of the invention can be seen having a main support frame portion 11 with an inversion table assembly 12 pivotally secured within. The main support frame portion 11 has a U-shaped rear frame 13 and an H-shaped front frame 14 secured together by respective bracket bolt combination 16. The front frame 14 has a frame stabilizer and table stop cross support element 17 providing frame rigidity spacing midway along and between the spaced parallel frame leg members 14A and 14B and a stop for the range of table assembly 12 pivoted inversion as will be disclosed in greater detail hereinafter.

Correspondingly, the U-shaped rear frame 13 has a ground engaging cross bar member 18 with spaced parallel legs 18A and 18B extending therefrom. A pair of fixed contoured tubular arm rest grips 19 and 20 extend from and are secured to the rear frame legs 18A and 18B by inversion table assembly pivot fixtures 21 and 22 as will be described hereinafter.

The arm rest grips 19 and 20 each have an enlarged padded armrest portion 19A and 20A with curved tubular extensions 19B and 20B for registration with the inversion table assembly pivot fixtures 21 and 22 as noted and best seen in FIG. 1 of the drawings.

Each of the fixed armrest grips 19 and 20 has a return portion 19C and 20C extending from the respective armrest to the rear frame respective legs 18A and 18B being secured there through at 23 as illustrated in FIG. 2 of the drawings.

The inversion table assembly 12 has an elongated table platform surface 24 secured over a support frame having a central cross member 25 with respective upstanding attachment end brackets 26A and 26B. The table pivot bearing fixtures 21 and 22 each have a pivot bearing 23 and 24 with apertured extension links 23A and 23B extending therefrom for free registration with the respective end attachment brackets 26A and 26B by fasteners F as will be well understood by those skilled in the art. A table bearing adjustable lock assembly 38 is in communication with the table pivot fixtures 21 and has a lock engagement tab 38A It will be seen that a leg and foot engagement extension assembly 30 adjustably extends from the table's central support frame 25 with corresponding foot rest pads 26 and foot retainer rollers 27 on its free end.

This arrangement enables a user to lay on the inversion table platform surface 24 face up with the legs and feet extended resting on the foot rest pads 26 and their feet hooked under the retainer rollers 27. This orientation enables inversion by holding the user in place on the table platform surface 24 as it is pivoted to an inversion orientation position indicated by broken lines and directional arrow in FIG. 2 of the drawings while gripping the disclosed fixed armrest grips 19 and 20 which is typical of an inversion table user configuration.

The leg and foot support and retainment extension assembly 30 has an adapted exercising station assembly 31 including a bracket 32 extending therefrom with a T-shaped bar extension and receiving sockets 33A and 33B thereon in parallel spaced co-planar relation to one another.

Figure 3:
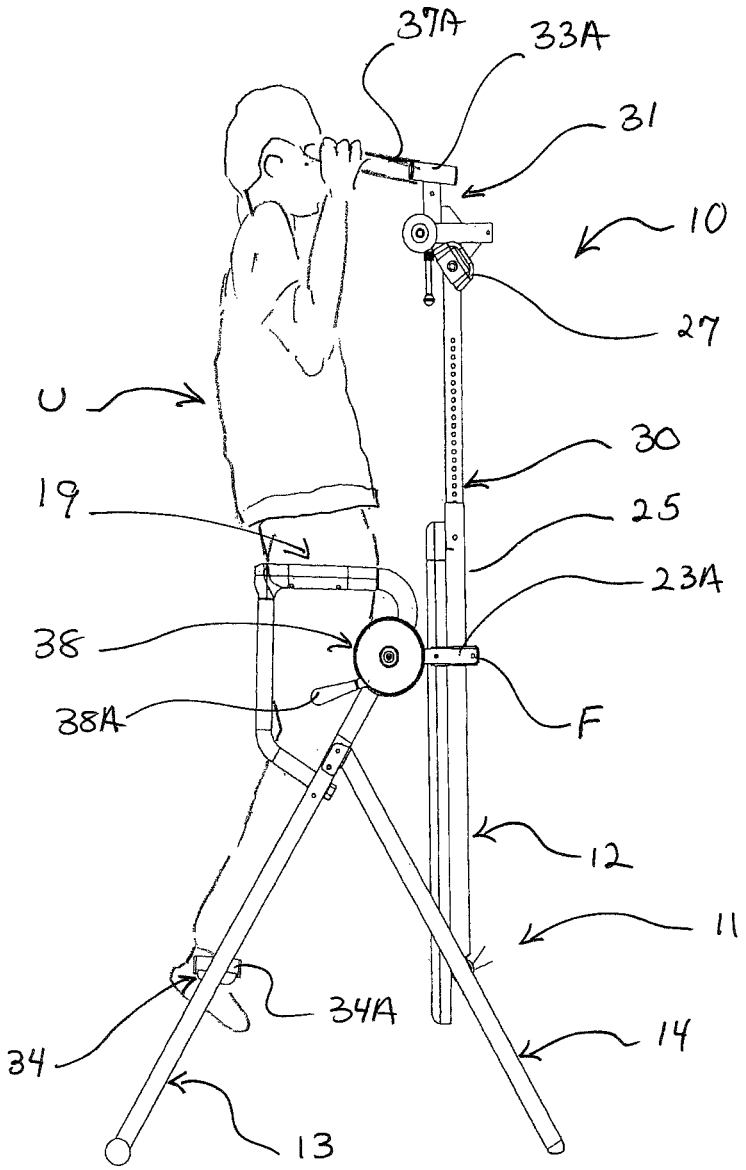
FIG. 3 is a side elevational view of the exercise inversion table in vertical locked exercise station chin up position with handgrip bars repositioned.

A second adapted exercise station assembly 34 is configured on the hereinbefore disclosed rear legs 18A and 18B can be best seen in FIGS. 2 and 3 of the drawings having a pair of parallel spaced bar receiving sleeves 34A and 34B in horizontal spaced relation.

A third adapted exercise station assembly 35 can be seen configured in the respective fixed armrest 19 and 20 having handgrip bar insert receiving sleeves 36A and 36B which are integrated there within and arranged for selective positioning of a pair of interchangeable repositional exercise handgrip bars 37A and 37B shown in broken lines in FIG. 1 and solid lines in FIGS. 3-6.

It will be evident therefore that the first, second and third adapted exercise station assemblies 31, 34 and 35 allow for selective handgrip bar's repositioning to achieve multiple exercises on a single unitary inversion table exercising device 10 of the invention as will be described in greater detail hereinafter.

Referring now to FIGS. 3-6 of the drawings, the inversion table exercising device 10 can be seen in multiple user adapted exercise station orientations to achieve separate and independent exercises, all on the same machine.

In operation, this is accomplished by placing the inversion table pivoting assembly 12 in a true locked vertical position by the locking assembly 38 with the leg and foot restraints facing upwardly and the selective repositioning of the independent handgrip bars 37A and 37B as follows.

Referring specifically to FIG. 3 of the drawings for a "chin up" exercise, the independent handgrip bars 37A and 37B are inserted into the receiving leg and foot sockets 33A and 33B allowing the user U, as illustrated, to engage and exercise.

Figure 4:
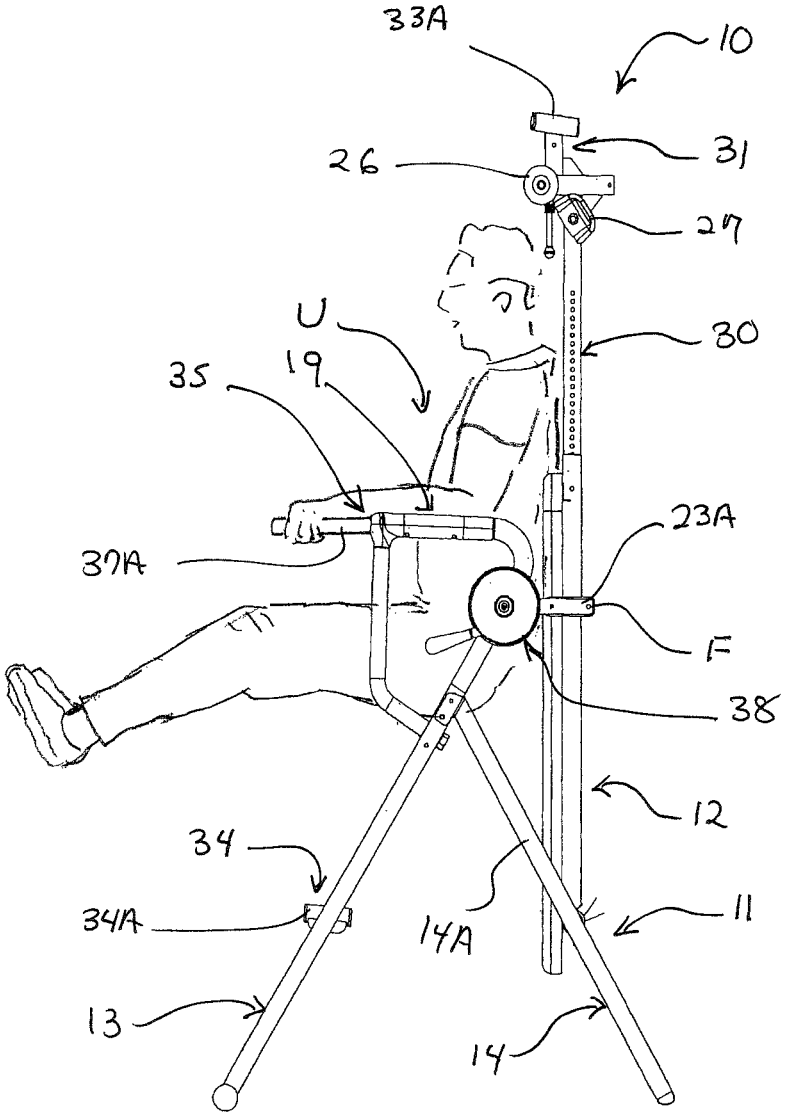
FIG. 4 is a side elevational view of the exercise inversion table in vertical locked exercise station position for leg raise exercises with handgrip bars repositioned to extend from the table's fixed armrest grips.

In FIG. 4 of the drawings, the independent handgrip bars 37A and 37B are repositioned into the fixed armrest grips 19 and 20 affording a "leg raise" exercise as illustrated and a so called "parallel bar dip" exercise which is characterized when the user lifts themselves up from a sitting position with their arms as is well known in the art, not shown.

Figure 5:
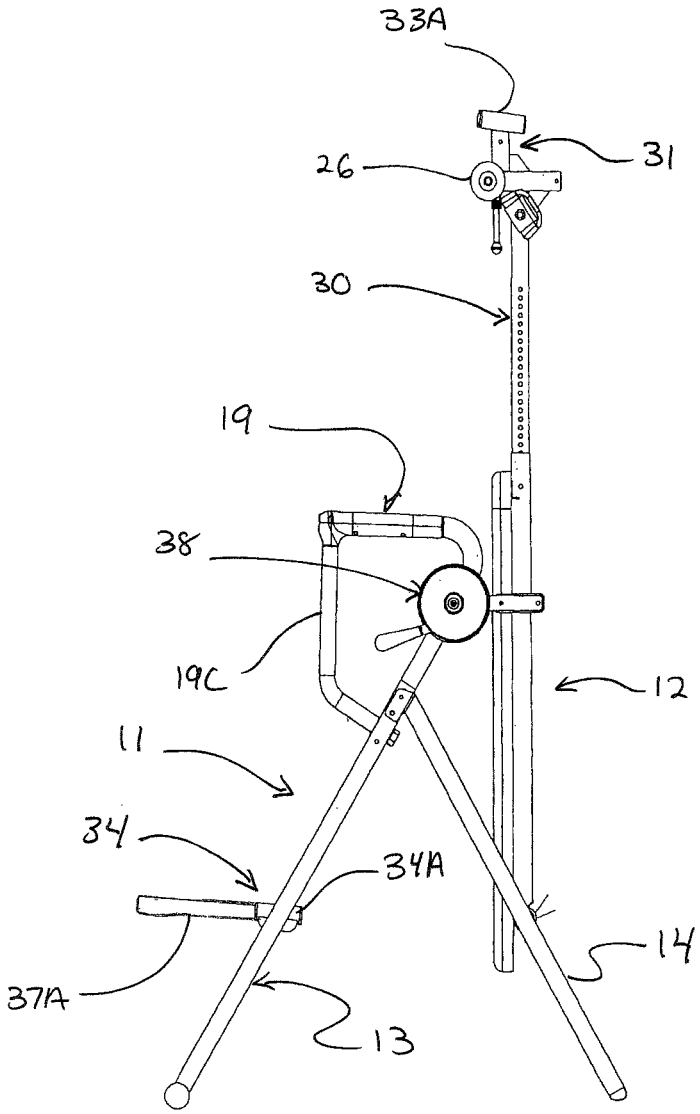
FIG. 5 is a side elevational view of the inversion table in vertical locked exercise position with the handgrip bars repositioned to its front support frame for squat and pushup exercise.

Referring now to FIG. 5 of the drawings, the independent handgrip bars 37A and 37B have been repositioned to the rear legs receiving sleeves 34A and 39B for a pushup exercise, not shown, as will be well understood by those skilled in the art.

It will be seen, therefore, that a number of independent exercises can be enabled on the unique inversion table exercising device 10 of the invention which heretofore was unavailable in a single integrated unit.

It will thus be seen that a new and novel inversion exercising table configuration device has been illustrated and described and it will be apparent to those skilled in the art that various changes and modifications may be made therein without departing from the spirit of the invention, therefore, I claim:

1. An exercise inversion table comprising in combination,
- a front support frame and a rear support frame being connected to the front frame and extending there beyond,
- an inversion table pivotally secured between respective free ends of said rear support frame in spaced relation to said front frame connection,
- a pair of fixed armrest handgrips on said rear frame,
- a leg and foot holder extending from one end of said inversion table,
- a pair of independently positioned handgrip bars configured to be removably secured independently from said respective rear frame to, said respective fixed armrest handgrips and to the leg and foot holder sequentially,
- a table pivot stop cross support on said front support frame for engagement with said leg and foot holder in spaced relation to said inversion table end.

2. The exercise inversion table set forth in claim 1 wherein said inversion table comprises,
- a longitudinally flat platform surface,
- a pair of oppositely disposed pivot links extending from said table to respective pivot bearing assemblies on said free ends of said rear frame.

3. The exercise inversion table set forth in claim 2 wherein an adjustable pivot bearing lock assembly is in communication with one of said pivot bearing assemblies.

4. The exercise inversion table set forth in claim 1 wherein said respective independently positioned handgrip bars are configured to be removably secured independently and sequentially to spaced bar receiving sleeves on respective legs of said rear frame and said leg and foot holder.

5. The exercise inversion table set forth in claim 1 wherein said respective independently positioned handgrip bars are removably sequentially in
- recessed bar receiving sockets in said fixed armrest handgrips.

6. The exercise inversion table set forth in claim 1 wherein said respective independently positioned handgrip bars are removably secured sequentially to
- a pair of angularly disposed co-planar spaced receiving sockets on a bracket extending from said leg and foot holder.

* * * * *